United States Patent [19]

Slattery

[11] Patent Number: 4,876,993

[45] Date of Patent: Oct. 31, 1989

[54] FUEL SYSTEM WITH VAPOR BYPASS OF OIL-FUEL MIXER HALTING OIL PUMPING

[75] Inventor: Gordon C. Slattery, Omro, Wis.

[73] Assignee: Brunswick Corporation, Skokie, Ill.

[21] Appl. No.: 217,655

[22] Filed: Jul. 12, 1988

[51] Int. Cl.[4] ..... F02B 33/02

[52] U.S. Cl. ..... 123/73 AD; 123/516; 417/380

[58] Field of Search ..... 123/516, 73 AD, 198 D; 184/6.4, 6.5; 417/404, 418, 380, 46, 395

[56] References Cited

U.S. PATENT DOCUMENTS

| | | | |
|---|---|---|---|
| 2,323,525 | 7/1943 | Ebel et al. | 123/516 |
| 3,924,975 | 12/1975 | Hundertmark | 417/395 |
| 4,383,504 | 5/1983 | Walsworth | 123/73 AD |
| 4,471,728 | 9/1984 | Borst et al. | 123/73 AD |
| 4,583,500 | 4/1986 | Hundertmark | 123/73 AD |
| 4,690,108 | 9/1987 | Debevec | 123/73 AD |

FOREIGN PATENT DOCUMENTS

| | | | |
|---|---|---|---|
| 3035535 | 4/1982 | Fed. Rep. of Germany | 123/516 |
| 3140119 | 4/1983 | Fed. Rep. of Germany | 123/516 |

*Primary Examiner*—David A. Okonsky

*Attorney, Agent, or Firm*—Andrus, Sceales, Starke & Sawall

[57] ABSTRACT

A marine propulsion system (200) having an outboard two cycle internal combustion engine (212) and an oil-fuel mixing fuel delivery system (2, 5, 7) has a vapor separator (702) connected to prevent excess oil in the mixture as fuel runs out. The vapor separator (702) has a fuel inlet (704) receiving fuel from the fuel tank (5), a fuel outlet (706) delivering fuel to the fuel inlet (4) of the oil-fuel mixer (2), and a vapor outlet (708) delivering vapor or air through a bypass connection (710) to the suction intake side of a fuel pump (11) and bypassing the mixer (2). The fuel pump (11) suctions oil-fuel mixture from the mixer (2). When the fuel tank (5) runs out of fuel, then air from the fuel tank (5) is sucked through the bypass connection (710) rather than through the mixer (2), which termination of flow through the mixer (2) stops further delivery of oil from the oil tank (7) to the engine (212) which would otherwise cause an overly rich oil-fuel mixture supplied to the engine (212) from the remaining oil-fuel mixture in a carburetor bowl or the like. The invention also maintains accuracy of the oil-fuel mixture ratio during normal operation.

6 Claims, 1 Drawing Sheet

FUEL SYSTEM WITH VAPOR BYPASS OF OIL-FUEL MIXER HALTING OIL PUMPING

BACKGROUND AND SUMMARY

The present invention relates to marine propulsion systems having an outboard two cycle internal combustion engine and a remote fuel tank, and more particularly to the fuel delivery system therefore.

The invention arose during development efforts directed toward solving a problem occuring as fuel runs out in systems using an automatic oil-fuel mixer, sometimes referred to as an autoblend unit, for example as shown in U.S. Pat. No. 4,583,500, incorporated herein by reference. The mixer draws fuel from a fuel tank and oil from an oil tank in a given ratio, typically about 50 parts fuel to 1 part oil, and automatically mixes the fuel and oil, eliminating the need to premix same. The mixer has a fuel inlet, an oil inlet, and an oil-fuel outlet, and is operated by a pressure differential between the fuel inlet and the oil-fuel outlet. The mixer may be operated by various sources of pressure differential, for example the mixer may be connected downstream of the fuel pump and use fuel pressure to operate the mixer. In other applications where a pressurized fuel tank is utilized, such pressure may be used to operate the mixer. In other implementations, crankcase pressure and/or vacuum may be used to operate the mixer, or a separate dedicated small pump may be used. In another implementation, the mixer is connected upstream of the fuel pump such that fuel pump suction on the oil-fuel outlet operates the mixer. In all the implementations, a problem of an overly rich oil-fuel mixture being supplied to the engine arises as fuel runs out.

In the last noted implementation, when the fuel tank runs out of fuel, then air from the tank is sucked through the mixer by the fuel pump. This air flow through the mixer continues to operate the mixer and causes continued delivery of oil from the oil tank to the engine, which in turn causes excess oil in the oil-fuel mixture as the fuel runs out, i.e. there is an overly rich oil-fuel mixture supplied to the engine from the remaining oil-fuel mixture in a carburetor bowl or the like as the latter runs dry.

The present invention addresses and solves the noted problem. Another solution is shown in copending application Ser. No. 07/218,310, filed on even date herewith, entitled "Automatic Oil-Fuel Mixer With Auxiliary Chamber".

It has also been found that the present invention enhances accuracy of the oil-fuel mixture ratio. In order to provide an accurate mix, the fuel must be in liquid form. If the fuel is in the form of vapor or if there are vapor or air bubbles in the fuel, then such air or vapor will displace the fuel in the mixer, and the oil-fuel mixture ratio will not be accurate. In the worst case, when only air is being drawn through the mixer as above noted when fuel runs out, then the mixer will provide all oil and no fuel. The present invention ensures that only fuel in the liquid form is mixed with the oil in the mixer, to maintain accuracy of the mixture ratio.

DETAILED DESCRIPTION

Figure 1:
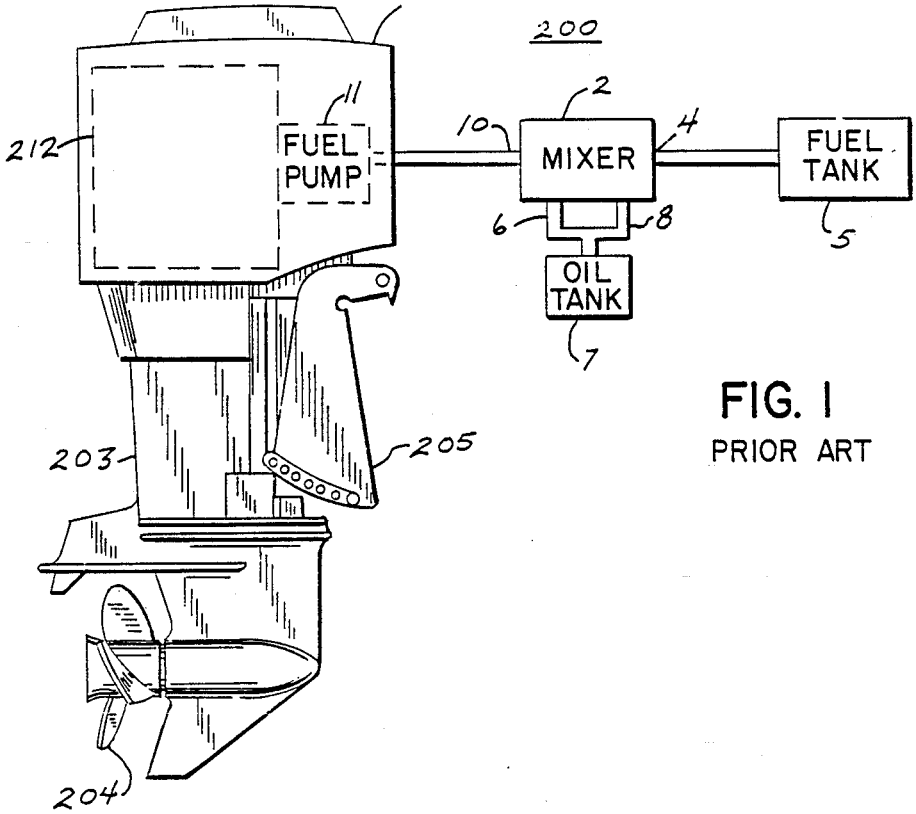
FIG. 1 PRIOR ART
FIG. 1 schematically shows a marine propulsion system and fuel delivery system known in the prior art.
Figure 2:
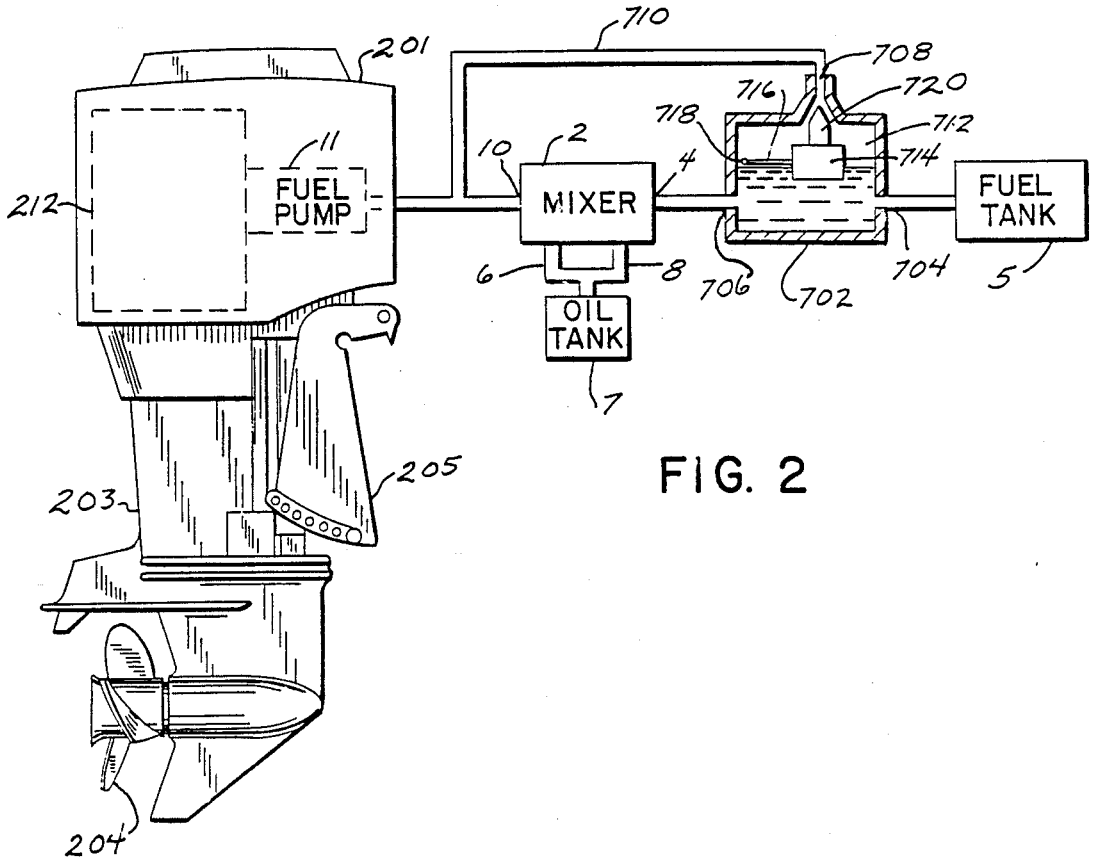
FIG. 2 shows a marine propulsion system and fuel delivery system in accordance with the invention.

FIGS. 1 and 2 use like reference numerals from incorporated U.S. Pat. No. 4,583,500 where appropriate to facilitate clarity. FIG. 1 shows a marine propulsion system 200 including an outboard propulsion unit having a powerhead 201 with a two cycle crankcase compression internal combustion engine 212 and having a lower depending gearcase 203 and propeller 204, and mounted to the transom of a boat (not shown) by transom bracket 205. A remote fuel tank 5 is within the boat. An oil-fuel mixer 2, as shown in incorporated U.S. Pat. No. 4,583,500, draws fuel from fuel tank 5 and oil from oil tank 7, and delivers an oil-fuel mixture to the engine. Mixer 2 has a fuel inlet 4 receiving fuel from fuel tank 5, an oil inlet 6, 8 receiving oil from oil tank 7, and an oil-fuel outlet 10 at port 20, FIGS. 2–4 of U.S. Pat. No. 4,583,500, delivering the oil-fuel mixture to the intake suction vacuum side of fuel pump 11, which is a crankcase pressure pulse driven pump, Mercury Marine Brunswick Corp. *Outboard Service Training Notebook*, Bulletin 90-90592 3-1286, pages 10–11, and for example U.S. Pat. No. 3,924,975, incorporated herein by reference. Mixer 2 is operated by a pressure differential between fuel inlet 4 and oil-fuel outlet 10. Fuel pump 11 suctions the oil-fuel mixture from oil-fuel outlet 10 of the mixer to provide such pressure differential.

As above noted, a problem with excess oil in the mixture occurs when fuel tank 5 runs out of fuel, because air from fuel tank 5 is then sucked through mixer 2 to operate same, such that the mixer continues to pump oil from oil tank 7 to oil-fuel outlet 10, whereby the mixture contains all oil and no fuel. This in turn causes an overly rich oil-fuel mixture to be supplied to the engine from the remaining mixture in a carburetor bowl, fuel injection system, or the like as the latter runs dry.

The present invention is shown in FIG. 2, and like reference numerals are used from FIG. 1 where appropriate to facilitate clarity. A vapor separator 702 is connected between fuel tank 5 and mixer 2. The vapor separator has a fuel inlet 704 receiving fuel from fuel tank 5, a fuel outlet 706 delivering vapor-free fuel to mixer 2, and a vapor outlet 708 delivering fuel vapor or air through bypass connection 710 to the engine, such that the vapor bypasses mixer 2. A float actuated shut-off valve 712 in the vapor separator closes outlet 708 when the fuel level in the vapor separator rises to a given level. The valve has a float 714 connected by lever 716 to pivot point 718 fixed to the vapor separator, such that as the fuel level in vapor separator 702 rises, valve member 720 moves upwardly to close outlet 708. When sufficient vapor or air is present, the fuel level lowers and valve 712 opens and allows the vapor or air to flow directly to outlet 10 of the mixer. When no vapor or air, or only a minimum amount thereof, is present, valve 712 closes. Vapor from outlet 708 is delivered through bypass connection 710 to the suction intake side of fuel pump 11 at oil-fuel outlet 10 of mixer 2.

When fuel tank 5 runs out of fuel, the fuel level in vapor separator 702 lowers, whereby valve 712 opens. Hence, air from tank 5 is sucked through open vapor outlet 708 and bypass connection 710, rather than through mixer 2. This termination of flow through mixer 2 stops operation thereof, whereby to stop pumping of oil thereby and hence stop further delivery of oil from oil tank 7 to the engine.

Another benefit of the invention is that during normal running of the engine, if there is vapor in the fuel, such vapor will rise in vapor separator 702 such that the fuel level in the latter lowers, which in turn opens valve 712 and allows escape of such vapor through bypass connection 710, bypassing mixer 2. This maintains accuracy of the mixture ratio by preventing substitution of vapor or air for liquid fuel in mixer 2, which would otherwise alter the mixture ratio.

It is recognized that various equivalents, alternatives and modifications are possible within the scope of the appended claim.

I claim:

1. A marine propulsion system comprising an outboard two cycle internal combustion engine, a fuel tank, an oil tank, an oil-fuel mixer having a fuel inlet receiving fuel from said fuel tank, an oil inlet receiving oil from said oil tank, and an oil-fuel outlet delivering an oil-fuel mixture to said engine, a vapor separator coupled to said mixer and removing fuel vapor from said fuel, wherein said vapor separator is connected between said fuel tank and said mixer.

2. The invention according to claim 1 wherein said vapor separator has a fuel inlet receiving fuel from said fuel tank, and a fuel outlet delivering vapor-free fuel to said mixer.

3. The invention according to claim 2 wherein said vapor separator has a vapor outlet delivering vapor to said engine, such that said vapor bypasses said mixer.

4. The invention according to claim 1 wherein said vapor separator has a vapor outlet, and comprising in combination a float actuated shut-off valve in said vapor separator responsive to a given fuel level in said vapor separator to close said vapor outlet of said vapor separator.

5. A marine propulsion system comprising an outboard two cycle internal combustion engine running on an oil-fuel mixture, a fuel system preventing excess oil in said mixture as said fuel runs out, comprising a fuel tank, an oil tank, an oil-fuel mixer having a fuel inlet receiving fuel from said fuel tank, an oil inlet receiving oil from said oil tank, and an oil-fuel outlet delivering an oil-fuel mixture to said engine, said mixer being operated by a pressure differential between said fuel inlet and said oil-fuel outlet, a fuel pump suctioning said oil-fuel mixture from said oil-fuel outlet of said mixer to provide said pressure differential, and pumping said oil-fuel mixture to said engine, a vapor separator connected between said fuel tank and said mixer, said vapor separator having a fuel inlet receiving fuel from said fuel tank, a fuel outlet delivering fuel to said fuel inlet of said mixer, and a vapor outlet delivering vapor through a bypass connection to said fuel pump and bypassing said mixer, such that if said fuel tank runs out of fuel, then air from said tank is sucked through said bypass connection rather than through said mixer, to terminate the flow through said mixer and stop operation of said mixer and stop further delivery of oil from said oil tank to said engine which would otherwise cause an overly rich oil-fuel mixture supplied to said engine from the remaining oil-fuel mixture in a carburetor bowl or the like.

6. The invention according to claim 5 wherein said vapor separator has a float actuated shut-off valve responsive to a given fuel level in said vapor separator to close said vapor outlet of said vapor separator.

* * * * *